US011624345B2

(12) United States Patent
Ito et al.

(10) Patent No.: US 11,624,345 B2
(45) Date of Patent: Apr. 11, 2023

(54) RECOIL STARTER

(71) Applicants: HONDA MOTOR CO., LTD., Tokyo (JP); Starting Industrial Co., Ltd., Tokyo (JP)

(72) Inventors: Mitsuhiro Ito, Wako (JP); Yutaro Kinoshita, Wako (JP); Tomoyasu Mizuno, Tokyo (JP); Yoshinori Horikoshi, Tokyo (JP)

(73) Assignees: HONDA MOTOR CO., LTD., Tokyo (JP); STARTING INDUSTRIAL CO., LTD., Tokyo (JP)

( * ) Notice: Subject to any disclaimer, the term of this patent is extended or adjusted under 35 U.S.C. 154(b) by 0 days.

(21) Appl. No.: 17/690,765

(22) Filed: Mar. 9, 2022

(65) Prior Publication Data

US 2022/0299001 A1 Sep. 22, 2022

(30) Foreign Application Priority Data

Mar. 19, 2021 (JP) ..... JP2021-046421

(51) Int. Cl.
*F02N 3/02* (2006.01)
*F02N 15/02* (2006.01)

(52) U.S. Cl.
CPC ..... *F02N 3/02* (2013.01); *F02N 15/027* (2013.01)

(58) Field of Classification Search
CPC ..... F02N 3/02; F02N 15/027
See application file for complete search history.

(56) References Cited

U.S. PATENT DOCUMENTS

2002/0185352 A1* 12/2002 Husges ..... F02N 3/02 74/6
2006/0070596 A1* 4/2006 Horikoshi ..... F02N 3/02 123/185.3
2006/0081209 A1* 4/2006 Hashiba ..... F16D 41/12 123/185.3
2007/0012266 A1* 1/2007 Westerlund ..... F02N 3/02 123/185.3
2008/0271698 A1* 11/2008 Zimmermann ..... F02N 3/02 123/185.2
2014/0190440 A1* 7/2014 Kato ..... F02N 15/027 123/185.3
2015/0107542 A1* 4/2015 Kyokane ..... F02N 19/001 123/179.28
2016/0138546 A1* 5/2016 Fujita ..... F02N 15/10 123/185.3

FOREIGN PATENT DOCUMENTS

JP 6509530 5/2019

* cited by examiner

*Primary Examiner* — Logan M Kraft
*Assistant Examiner* — Anthony L Bacon
(74) *Attorney, Agent, or Firm* — Rankin, Hill & Clark LLP

(57) ABSTRACT

In a recoil starter that starts an engine, the recoil starter rotating a drive shaft of the engine using rotation force of a reel through a recoil rope wound around the reel, by the recoil rope being pulled, a ratchet claw is provided on the reel, the ratchet claw pivoting in a radial direction of the reel with rotation of the reel by the recoil rope and then engaging with a pulley provided on the drive shaft, a guide member is provided around a reel shaft, the guide member covering the ratchet claw, the reel shaft being a rotation shaft of the reel, and a rib is provided on the guide member, the rib abutting on the ratchet claw.

3 Claims, 7 Drawing Sheets

RECOIL STARTER

INCORPORATION BY REFERENCE

The present application claims priority under 35 U.S.C. § 119 to Japanese Patent Application No. 2021-046421 filed on Mar. 19, 2021. The content of the application is incorporated herein by reference in its entirety.

BACKGROUND OF THE INVENTION

Field of the Invention

The present invention relates to a recoil starter.

Description of the Related Art

Conventionally, there have been recoil starters each of which includes a reel and a recoil rope wound around the reel and each of which starts an engine by rotating a drive shaft of the engine with rotation of the reel by the recoil rope being pulled. Among such recoil starters, there is known a recoil starter in which a ratchet claw is provided. The ratchet claw engages with a pulley provided on the drive shaft, and thereby the rotation force of the reel is transmitted to the drive shaft of the engine. The ratchet claw pivots with the rotation of the reel, and can engage with or disengage from the pulley depending on the rotation direction of the reel (see Japanese Patent No. 6509530, for example).

However, in the conventional recoil starter, there has been a risk that the vibration caused by the engine operation, for example, may be transmitted to the coil starter, so that a ratchet member is caused to vibrate and abrasion is produced in the ratchet member or other components that are in contact with the ratchet member.

The present invention provides a recoil starter that can restrain the ratchet claw from vibrating.

SUMMARY OF THE INVENTION

An aspect of the present invention is a recoil starter that starts an engine, the recoil starter rotating a drive shaft of the engine using rotation force of a reel through a recoil rope wound around the reel, by the recoil rope being pulled, in which: a ratchet claw is provided on the reel, the ratchet claw pivoting in a radial direction of the reel with rotation of the reel by the recoil rope and then engaging with a pulley provided on the drive shaft; a guide member is provided around a reel shaft, the guide member covering the ratchet claw, the reel shaft being a rotation shaft of the reel; and a rib is provided on the guide member, the rib abutting on the ratchet claw.

According to the aspect of the present invention, it is possible to restrain the ratchet claw from vibrating.

DETAILED DESCRIPTION OF THE PREFERRED EMBODIMENTS

An embodiment of the present invention will be described below based on the accompanying drawings. In each of the accompanying drawings, Up denotes an upward direction, Fr denotes a forward direction, and Lh denotes a leftward direction.

Figure 1:
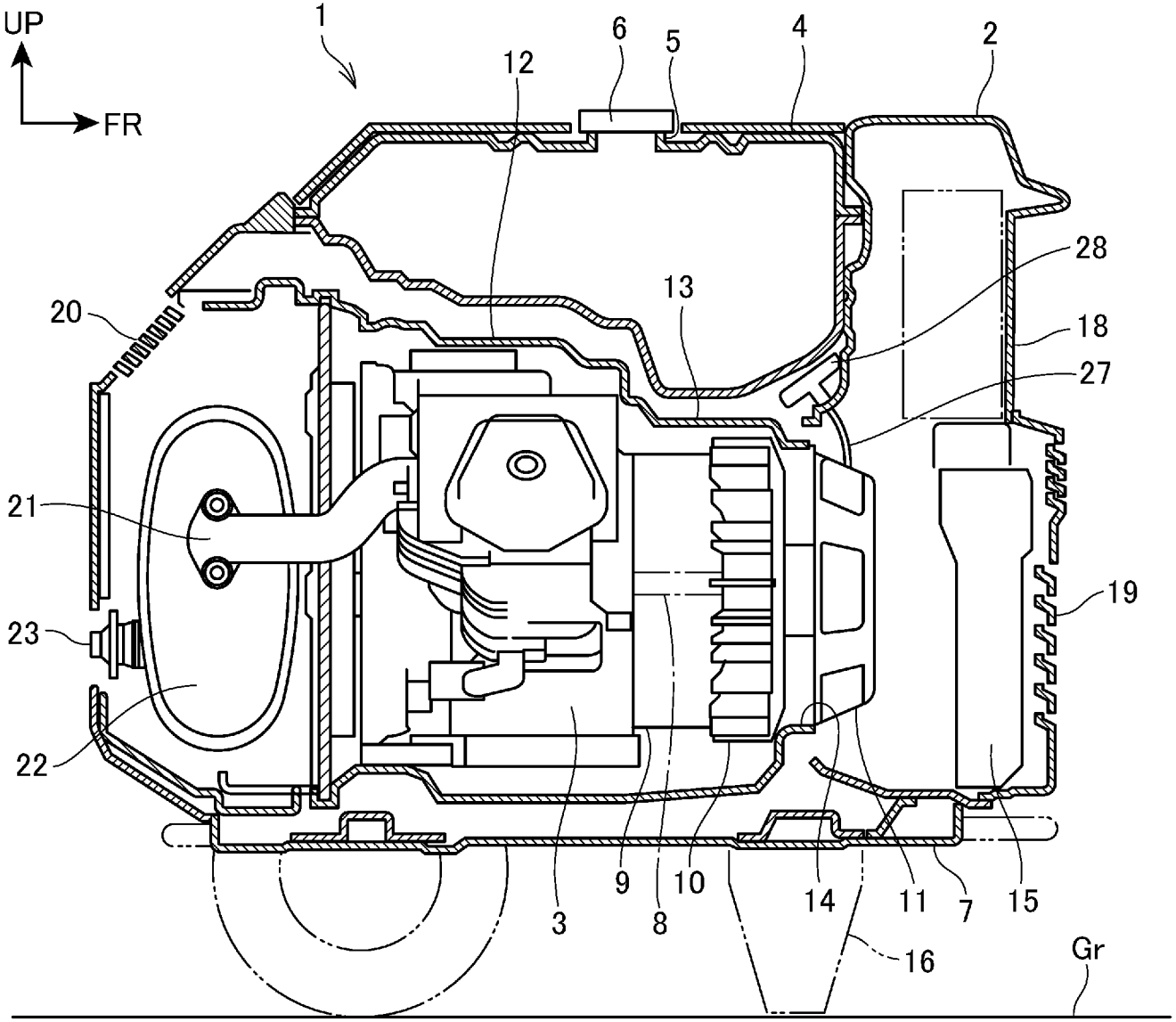
FIG. 1 is a lateral sectional view showing a schematic configuration of the interior of an electric generator according to an embodiment of the present invention.

FIG. 1 is a lateral sectional view showing a schematic configuration of the interior of an electric generator 1 according to the embodiment of the present invention. In FIG. 1, Gr denotes an installation surface for the electric generator 1.

As shown in FIG. 1, the electric generator 1 includes a housing 2 formed of resin. An engine 3 is contained in the interior of the housing 2.

Further, a fuel tank 4 is contained in the interior of the housing 2. On a top board of the housing 2, an oil supply port 5 of the fuel tank 4 is provided so as to protrude to the exterior of the housing 2. An oil supply cap 6 for opening and closing the oil supply port 5 is attached to the oil supply port 5 in a detachable manner.

A support member 16 that supports the housing 2 is attached to a bottom cover 7 provided on a lower surface of the housing 2. An output shaft 8 is provided in the engine 3. An alternator 9 is attached to the output shaft 8 of the engine 3, coaxially with the output shaft 8.

Further, a fan 10 is coaxially attached in front of the alternator 9 of the output shaft 8. A recoil 11 for starting the engine 3 is disposed in front of the fan 10. By driving the engine 3, the alternator 9 is driven so as to rotate, so that electric power generation is performed. By driving the engine 3, the fan 10 is driven so as to rotate, so that the air outside the housing 2 is taken in and is sent toward the engine 3.

A shroud 12 that guides the air sent by the fan 10 to and around the engine 3 is disposed on the outside of the engine 3. A fan cover 13 that covers the alternator 9 and the fan 10 is disposed at a front end of the shroud 12. The fan cover 13 is formed in a tapered shape such that the front side has a smaller diameter, and a ventilation opening 14 is formed at a front end portion of the fan cover 13.

The ventilation opening 14 is formed substantially concentrically with a rotation shaft of the engine 3. An inverter 15 is installed in front of the fan 10. A control panel 18 on which an electric power outlet, an operation button and the like are disposed is attached to a front surface of the housing 2.

Further, an intake port 19 for taking external air into the interior of the housing 2 is formed on the front surface of the housing 2. An exhaust port 20 for discharging the air in the interior of the housing 2 is formed on a rear surface of the housing 2. The electric generator 1 takes the air outside the housing 2 from the intake port 19, by driving the engine 3 and thereby driving and rotating the fan 10.

The air from the intake port 19 flows into the inside of the fan cover 13 through the ventilation opening 14, cools the engine 3 while flowing between the engine 3 and the shroud 12, and thereafter, is discharged from the exhaust port 20 to the outside.

A muffler 22 is provided through an exhaust pipe 21, behind the engine 3.

The exhaust pipe 21 leads exhaust air from the engine 3 to the muffler 22, and the muffler 22 purifies the exhaust air and reduces exhaust sound.

The muffler 22 includes a tail pipe 23, and a rear end of the tail pipe 23 is exposed to the outside from a back surface of the housing 2.

Next, the recoil 11 will be described.

Figure 2:
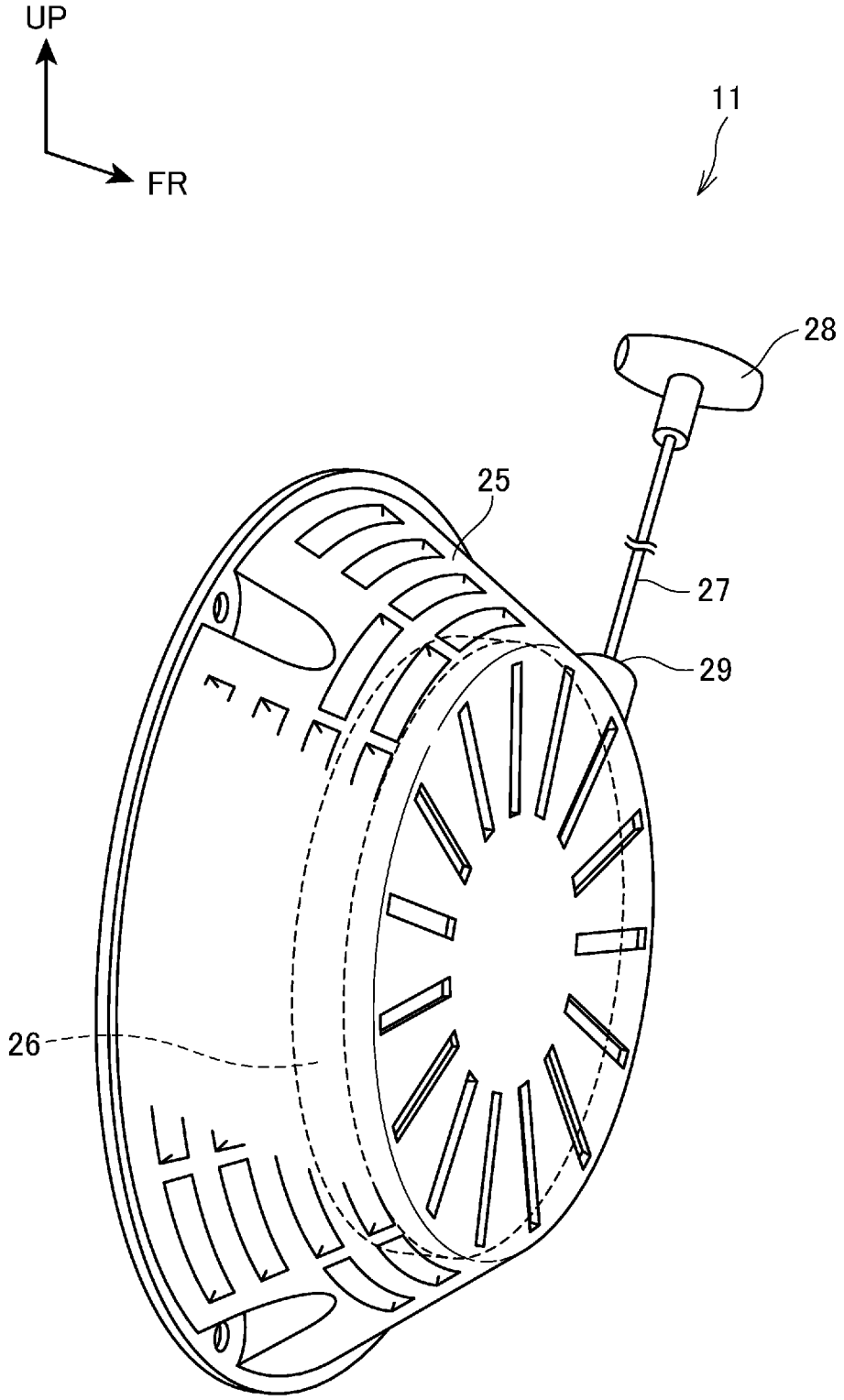
FIG. 2 is a perspective view of a recoil.

FIG. 2 is a perspective view of the recoil 11.

The recoil 11 corresponds to an example of the recoil starter. The recoil 11 includes a recoil cover 25, a substantially ring-shaped reel 26 that is supported on a back surface side of the recoil cover 25 in a rotatable manner, and a recoil rope 27 that is wound around the reel 26.

One end of the recoil rope 27 is pulled out to the outside of the recoil cover 25 through an insertion hole 29 provided in the recoil cover 25. A recoil grip 28 is attached to the one end of the recoil rope 27. The reel 26 is rotated by pulling of the recoil rope 27.

Figure 3:
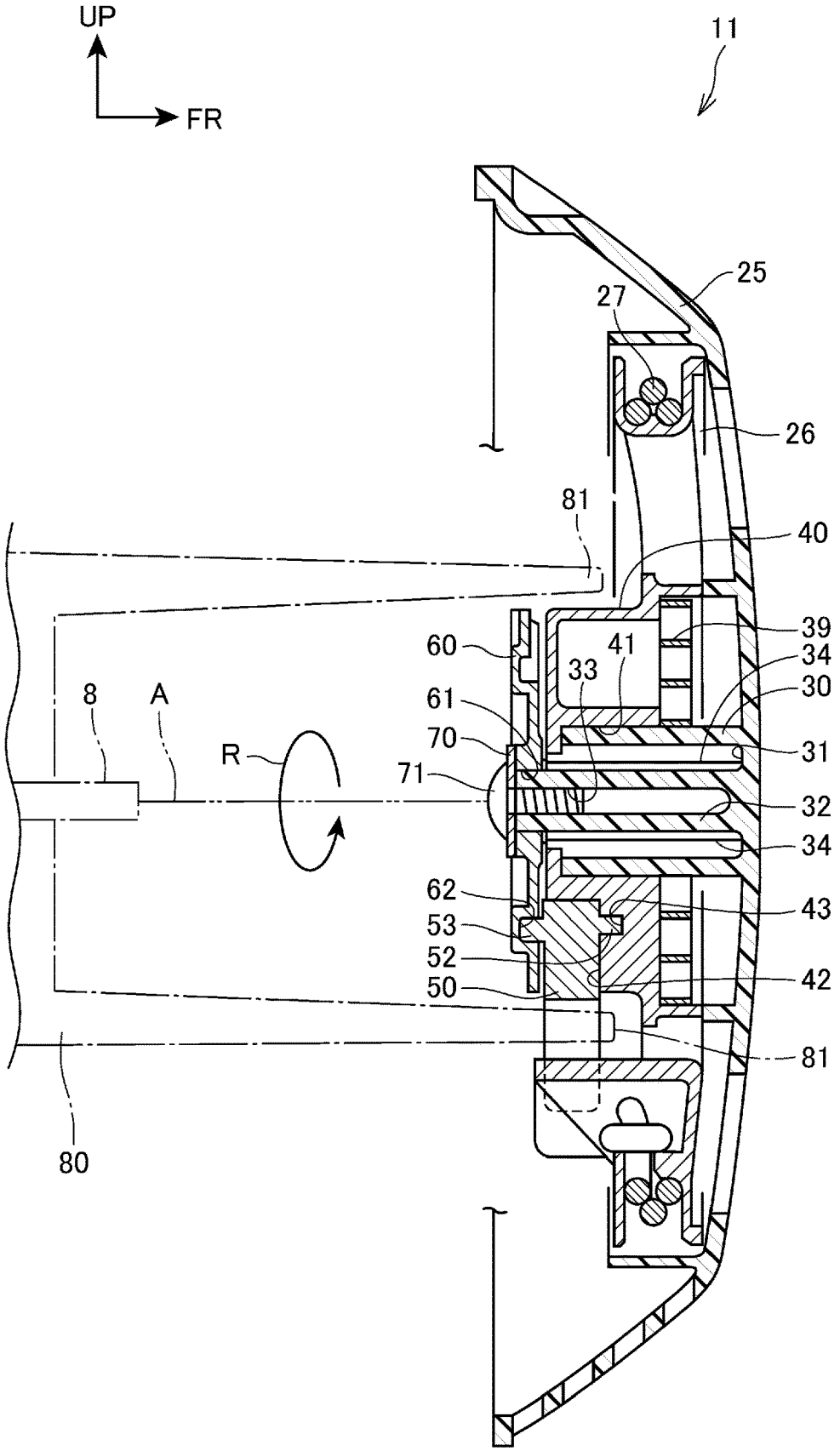
FIG. 3 is a longitudinal sectional view of the recoil.

FIG. 3 is a longitudinal sectional view of the recoil 11. In FIG. 3, a rotation direction R of the reel 26 when the recoil rope 27 is pulled is shown by an arrow, and a rotation axis A of the reel 26 when the recoil rope 27 is pulled is shown by a two-dot chain line.

As shown in FIG. 3, a cylindrical reel boss 30 that protrudes toward the engine 3 is provided on the recoil cover 25. A concave portion 31 that is depressed from a distal end toward the front surface of the recoil cover 25 is provided on the reel boss 30.

One end of a spiral spring 39 is attached to the reel boss 30. The spiral spring 39 is disposed so as to be wound around the reel boss 30 using the reel boss 30 as a central axis. In other words, the spiral spring 39 is contained in the recoil cover 25, such that the reel boss 30 is inserted into the center of the spiral spring 39.

A cylindrical guide boss 32 that has a smaller diameter than the reel boss 30 and that protrudes toward the engine 3 similarly to the reel boss 30 is provided in the concave portion 31. A distal end of the guide boss 32 protrudes closer to the engine 3 than the distal end of the reel boss 30. A screw hole 33 is provided in an end surface of the guide boss 32.

A coil spring 34 is contained in the concave portion 31. The guide boss 32 is inserted into the inside of the coil spring 34. That is, in the concave portion 31, the coil spring 34 is disposed between the guide boss 32 and the reel boss 30. One end of the coil spring 34 is disposed at substantially the same position as the distal end of the guide boss 32.

As described above, the reel 26 is supported on the back surface side of the recoil cover 25 in a rotatable manner.

A rotation center portion 40 is provided substantially at the center of the reel 26. The rotation center portion 40 is formed in a substantially cylindrical shape that extends in a front-rear direction of the electric generator 1.

A through-hole 41 that extends in a thickness direction of the rotation center portion 40 is provided substantially at the center of the rotation center portion 40. The reel boss 30 is inserted into the through-hole 41. Thereby, the reel 26 is supported by the reel boss 30 so as to be rotatable about the reel boss 30. That is, the reel boss 30 functions as a reel shaft that is a rotation shaft of the reel 26.

The other end of the spiral spring 39 is attached to the rotation center portion 40. By the elastic force of the spiral spring 39, the reel 26 is biased in the reverse direction of the rotation direction R of the reel 26 when the recoil rope 27 is pulled.

Figure 4:
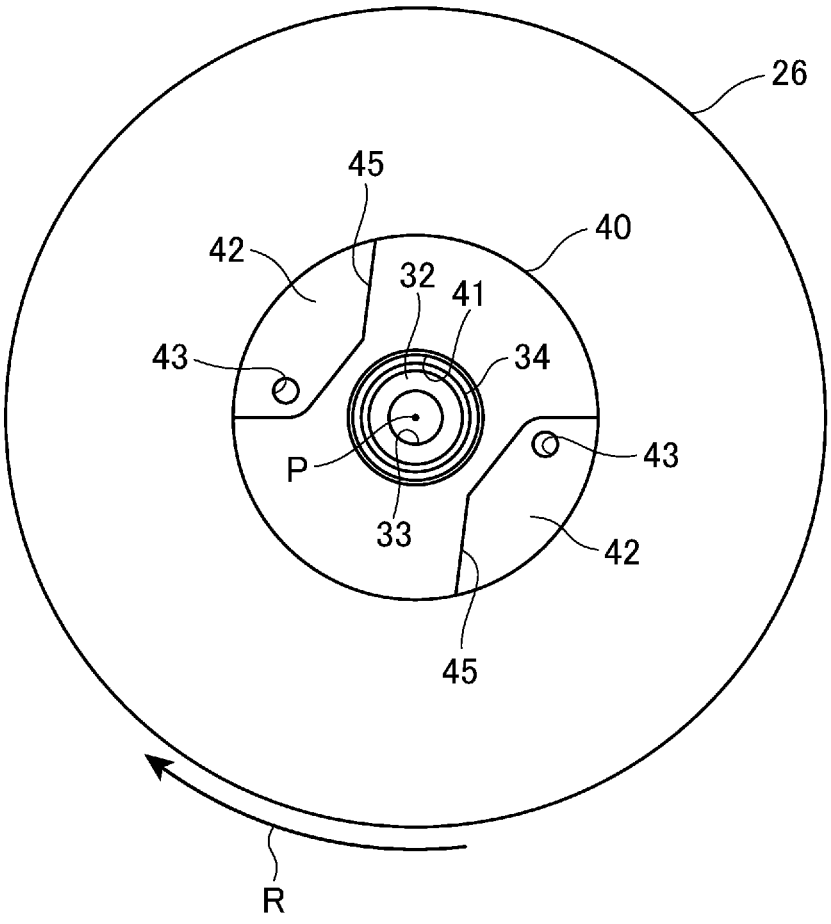
FIG. 4 is a plan view of a reel.

FIG. 4 is a plan view of the reel 26 as viewed from the engine 3 side. In FIG. 4, ratchet claws 50 are not illustrated.

As shown in FIG. 4, a plurality of containing portions 42 are provided in the rotation center portion 40. Each containing portion 42 has a concave shape that is depressed toward the recoil cover 25 from a top surface of the rotation center portion 40 that is positioned on the side of the engine 3. Further, the containing portions 42 are disposed along the circumference of the rotation center portion 40. In the embodiment, in the rotation center portion 40, two containing portions 42 are provided in a mutually point-symmetrical manner with respect to a symmetrical point P through which a rotation axis A passes.

A shaft hole 43 that is further depressed toward the recoil cover 25 is provided on each top surface of the containing portions 42.

A containing surface 45 that is a flat surface provided so as to stand from the top surface of the containing portion 42 is formed on each containing portion 42.

Figure 5:
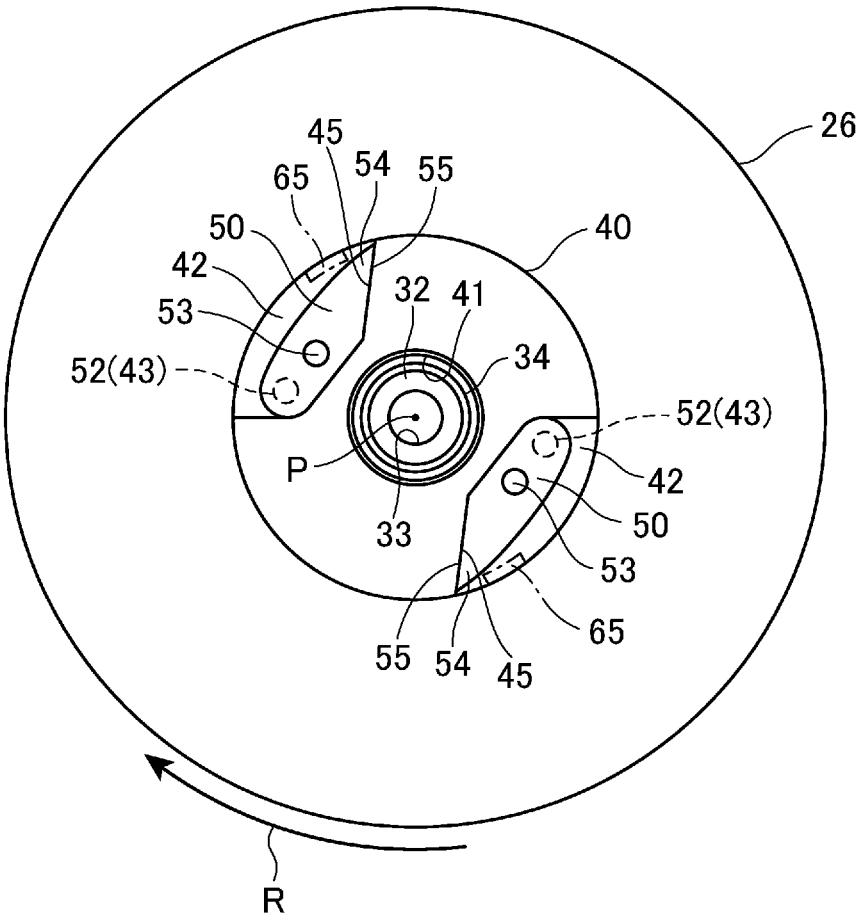
FIG. 5 is a plan view of the reel.

FIG. 5 is a plan view of the reel 26 as viewed from the engine 3 side.

Ratchet claws 50 are attached to the respective containing portions 42. Each ratchet claw 50 in the embodiment is a claw-shaped member that is formed of a resin material and that has a predetermined length. A pivot shaft 52 having a convex shape is provided on a surface of the ratchet claw 50 that is positioned on the side of the rotation center portion 40. The pivot shaft 52 is provided on one end portion in a longitudinal direction of the ratchet claw 50. The pivot shaft 52 is fit in the shaft hole 43. Thereby, the ratchet claw 50 is supported in the rotation center portion 40 in a rotatable manner.

The ratchet claws 50 are disposed at even intervals in a circumferential direction of the rotation center portion 40. Further, the respective ratchet claws 50 attached to the rotation center portion 40 are disposed in a mutually point-symmetrical manner with respect to the symmetrical point P through which the rotation axis A passes.

A guide shaft 53 that is a protrusion portion is provided on a surface of the ratchet claw 50 that is positioned on the side of the engine 3. That is, the guide shaft 53 is provided on the opposite side of the pivot shaft 52 in the ratchet claw 50.

A pointed end portion 54 having an acute angle is provided on the other end portion in the longitudinal direction of the ratchet claw 50. An engagement surface 55 that is a flat surface is provided on the pointed end portion 54 on the side of the through-hole 41.

As shown in FIG. 3, the recoil 11 includes a ratchet guide 60. The ratchet guide 60 corresponds to an example of the guide member. The ratchet guide 60 is a member that is formed in a disk shape having substantially the same diameter as the top surface of the rotation center portion 40. The ratchet guide 60 in the embodiment is formed of a resin material. A central hole 61 that is a through-hole is provided substantially at the center of the ratchet guide 60. The guide boss 32 is inserted into the central hole 61. Thereby, the ratchet guide 60 is supported by the guide boss 32 so as to be rotatable about the guide boss 32.

A ring-shaped braking plate 70 is attached to a surface of the ratchet guide 60 on the side of the engine 3. The ratchet guide 60 is screwed to the rotation center portion 40 by a screw member 71 through the braking plate 70. The screw member 71 is inserted into a through-hole provided on the braking plate 70 and the central hole 61, and screws with the screw hole 33.

In this way, the ratchet guide 60 attached to the guide boss 32 is supported while being sandwiched between the coil spring 34 and the braking plate 70.

Thereby, even when the reel 26 rotates, the ratchet guide 60 is restrained from rotating until a torque having a certain value or higher is given.

Figure 6:
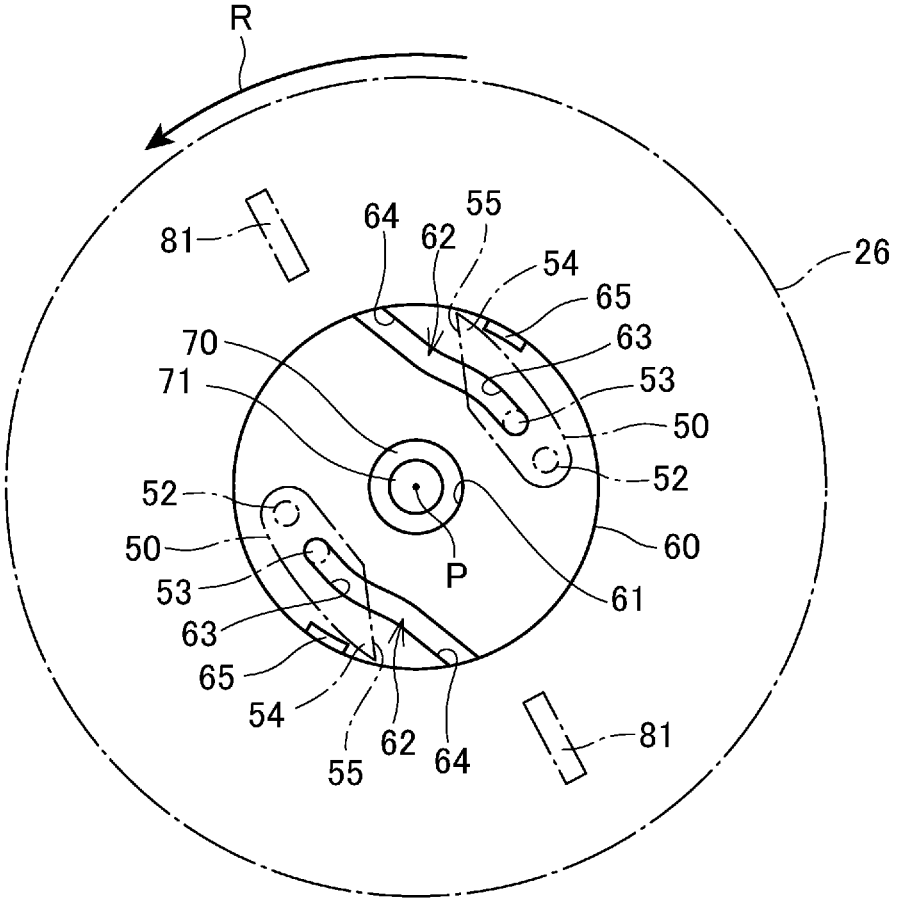
FIG. 6 is a plan view of a ratchet guide.

FIG. 6 is a plan view of the ratchet guide 60 as viewed from the reel 26 side. In FIG. 6, disposed positions of the ratchet claws 50 and engagement portions 81 relative to the ratchet guide 60 are virtually shown by one-dot chain lines.

The ratchet guide 60 attached to the guide boss 32 covers the rotation center portion 40 and the pair of ratchet claws 50, at a predetermined interval from the rotation center portion 40.

As shown in FIG. 6, a pair of guide grooves 62 are provided on a surface of the ratchet guide 60 that faces the top surface of the rotation center portion 40. On the ratchet guide 60, the pair of guide grooves 62 are disposed in a mutually point-symmetrical manner with respect to the symmetrical point P through which the rotation axis A passes.

Each guide groove 62 is formed such that a circular arc groove 63 and a linear groove 64 are joined. The circular arc groove 63 is a groove portion that extends in a curved manner around the symmetrical point P in an arc. Each circular arc groove 63 is disposed at respective predetermined distances away from an edge portion of the ratchet guide 60 and the central hole 61.

The linear groove 64 is a groove portion that has a substantially straight line shape and that extends from one end portion of the circular arc groove 63 to the edge portion of the ratchet guide 60.

Each guide groove 62 engages with the guide shaft 53 of the ratchet claw 50. Each guide shaft 53 can slide along the guide groove 62 in the interior of the guide groove 62.

In the case where the recoil rope 27 is not pulled and where the reel 26 is in a stationary state without rotating, each guide shaft 53 is contained in the other end portion of the circular arc groove 63. In the guide groove 62, the other end portion of the circular arc groove 63 is positioned on the opposite side of the edge portion of the ratchet guide 60.

Further, in this case, the whole of each ratchet claw 50 is contained in the containing portion 42, and the whole of the engagement surface 55 abuts on the containing surface 45.

A pair of ribs 65 provided so as to stand toward the top surface of the rotation center portion 40 are provided at the edge portion of the ratchet guide 60. The ribs 65 are disposed at a predetermined interval from each other, in a circumferential direction of the ratchet guide 60. Each rib 65 has such a height that the rib 65 does not abut on the top surface of the containing portion 42.

In the case where the recoil rope 27 is not pulled and where the reel 26 is in a stationary state without rotating, each rib 65 abuts on the pointed end portion 54 of the ratchet claw 50 from the circumference side of the rotation center portion 40.

That is, in the case where the recoil rope 27 is not pulled and where the reel 26 is in a stationary state without rotating, each pointed end portion 54 is fixed by being sandwiched between the containing surface 45 and the rib 65.

Thereby, even when vibration is propagated to the ratchet claw 50, the ratchet claw 50 is restrained from vibrating or pivoting.

As shown in FIG. 3, a pulley 80 is attached to a distal end portion of the output shaft 8. The pulley 80 is a member that is formed in a bucket shape, and a bottom surface of the pulley 80 is disposed at a position that faces the top surface of the rotation center portion 40.

A plurality of engagement portions 81 are provided in the pulley 80. The engagement portions 81 are disposed at a predetermined interval from each other, in a circumferential direction of the pulley 80. Each engagement portion 81 is formed so as to extend to a position that faces a circumferential surface of the rotation center portion 40.

Next, the operation of the embodiment will be described.

For the electric generator 1, a worker grasps and pulls the recoil grip 28, and thereby the recoil rope 27 is pulled out, so that the reel 26 rotates. The rotation force of the reel 26 is transmitted to the output shaft 8 through the pulley 80, and thereby the output shaft 8 rotates. Thereby, the engine 3 starts because the output shaft 8 is a drive shaft of the engine.

In the electric generator 1, by the drive of the engine 3, a rotor of the alternator 9 is rotated through the output shaft 8, and voltage can be supplied from the alternator 9.

The motion of the recoil 11 will be described in detail. As described above, in the case where the recoil rope 27 is not pulled and where the reel 26 is in a stationary state without rotating, the whole of each ratchet claw 50 is contained in the containing portion 42. That is, each ratchet claw 50 is disposed on the inside in a radial direction of the rotation center portion 40.

Figure 7:
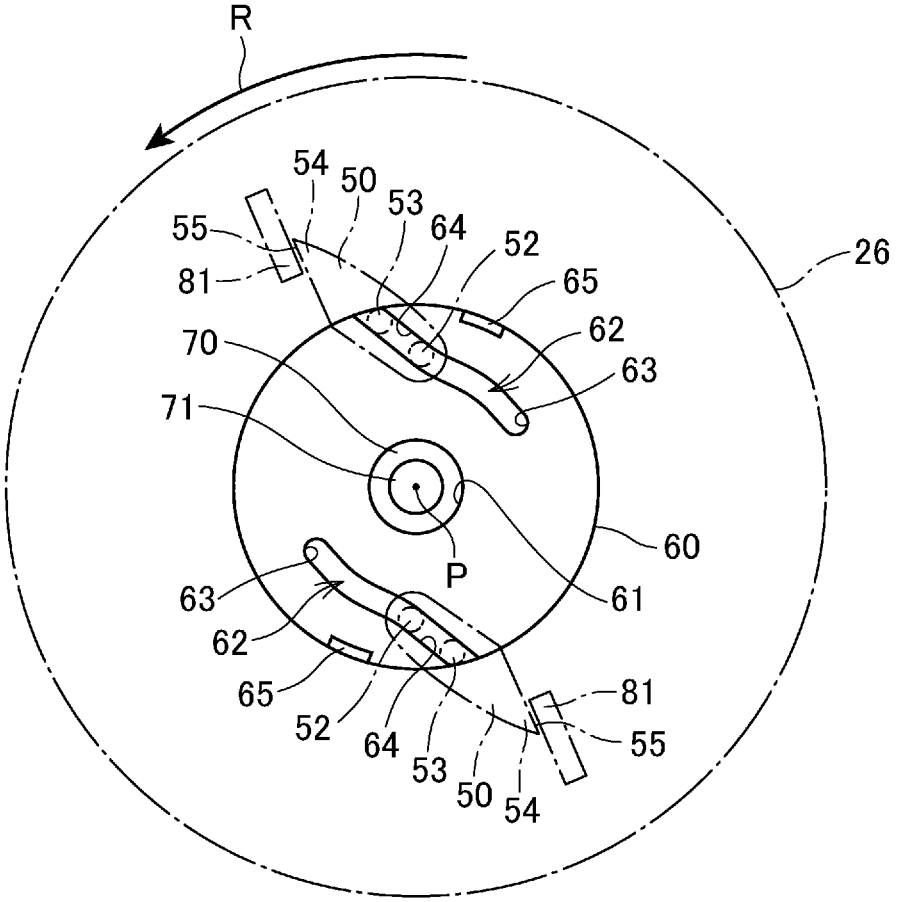
FIG. 7 is a plan view of the ratchet guide.

FIG. 7 is a plan view of the ratchet guide 60 as viewed from the reel 26 side when the recoil rope 27 is pulled out. In FIG. 7, disposed positions of the ratchet claws 50 and the engagement portions 81 relative to the ratchet guide 60 are virtually shown by one-dot chain lines.

As shown in FIG. 7, when the recoil rope 27 is pulled out, the reel 26 rotates in the rotation direction R. On the other hand, the ratchet guide 60 maintains a stationary state without rotating. Thereby, each ratchet claw 50 rotates relative to the ratchet guide 60.

Then, in the interior of each guide groove 62, the guide shaft 53 slides along the guide groove 62 from the other end portion of the circular arc groove 63 to the edge portion of the ratchet guide 60 to which the linear groove 64 is joined.

At the same time, the pointed end portion 54 of each ratchet claw 50 departs from the rib 65 in the circumferential direction of the rotation center portion 40.

Thereby, each ratchet claw 50 pivots about the pivot shaft 52 outward in the radial direction of the rotation center portion 40. Then, the pointed end portion 54 of each ratchet claw 50 engages with the engagement portion 81. When the reel 26 further continues to rotate in this state, each ratchet claw 50 gives torque to the pulley 80 through the engagement portion 81, and rotates the pulley 80. Thereby, the rotation force of the reel 26 is given to the output shaft 8 through the pulley 80, and the output shaft 8 rotates, so that the engine 3 starts.

When the pointed end portion 54 of each ratchet claw 50 engages with the engagement portion 81, the ratchet guide 60 also starts to rotate integrally with each ratchet claw 50 and the reel 26, because of being pressed by the guide shaft 53.

After the engine 3 starts, the reel 26 is rotated in the reverse direction of the direction at the start of the engine 3, by the rotation force accumulated in the spiral spring 39, and the pulled-out recoil rope 27 is rewound.

In this case, each ratchet claw 50 rotates in the reverse direction of the direction when the recoil rope 27 is pulled out, relative to the ratchet guide 60.

Then, in the interior of each guide groove 62, the guide shaft 53 slides along the guide groove 62 in the reverse direction of the direction when the recoil rope 27 is pulled out.

Then, each ratchet claw 50 returns to the position in the stationary state where the reel 26 does not rotate.

When the reel 26 rotates, each guide shaft 53 slides without getting out of the interior of the guide groove 62. That is, each guide shaft 53 is constantly covered by the ratchet guide 60 both in the case of the rotation of the reel 26 and in the case of the stationary state.

Further, when the reel 26 rotates, each rib 65 is constantly disposed in the interior of the containing portion 42. Therefore, each rib 65 is restrained from coming in contact with the rotation center portion 40.

When the engine 3 is driven, the vibration caused by the drive of the engine 3 is propagated to each portion of the recoil 11.

In the embodiment, each pointed end portion 54 of the ratchet claws 50 is fixed by being sandwiched between the containing surface 45 and the rib 65.

Thereby, in the electric generator 1, even when the vibration is propagated to the ratchet claw 50, it is possible to restrain the ratchet claw 50 from vibrating or pivoting.

As described above, in the embodiment, the ratchet claws 50 each of which pivots in the radial direction of the reel 26 with the rotation of the reel 26 by the recoil rope 27 and then engages with the pulley 80 provided on the output shaft 8 are provided on the reel 26 of the recoil 11. The guide boss 32 is provided in the reel boss 30 that functions as the rotation shaft of the reel 26. The ratchet guide 60 that covers the ratchet claws 50 is provided on the guide boss 32, and the ribs 65 each of which abuts on the ratchet claw 50 is provided on the ratchet guide 60.

Thereby, each pointed end portion 54 of the ratchet claws 50 is fixed by being sandwiched between the containing surface 45 and the rib 65. Therefore, in the electric generator 1, even when the vibration is propagated to the ratchet claw 50, it is possible to restrain the ratchet claw 50 from vibrating or pivoting, and it is possible to achieve the durability of the ratchet claw 50 and the reel 26 and the restraint of noise due to the vibration of the ratchet claw 50.

Further, it is possible to fix each ratchet claw 50 without using a biasing member such as a spring, and therefore it is possible to restrain the vibration of each ratchet claw 50 without increasing the number of components, and to restrain the increase in the pull-back load of the recoil rope 27.

Further, in the embodiment, each rib 65 is configured to release the ratchet claw 50 that moves in the circumferential direction of the ratchet guide 60, with the rotation of the reel 26 by the recoil rope 27 being pulled.

Thereby, when the reel 26 rotates, each rib 65 departs from the ratchet claw 50. Therefore, in the recoil 11, when the reel 26 rotates, it is possible to cause each ratchet claw 50 to smoothly pivot by releasing the ratchet claw 50.

Further, in the embodiment, the guide shaft 53 is provided on each ratchet claw 50, the guide groove 62 that engages with the guide shaft 53 is provided on the ratchet guide 60, and the ratchet guide 60 maintains the stationary state even when the recoil rope 27 is pulled. Each guide shaft 53 moves along the guide groove 62, with the rotation of the reel 26 by the recoil rope 27 being pulled, and the ratchet guide 60 is configured to have such a disk shape that the ratchet guide 60 covers the guide shaft 53 no matter what position in the guide groove 62 the guide shaft 53 moves to.

Thereby, it is possible to stabilize the shape and size of the ratchet guide 60, and to achieve the improvement in production easiness and stiffness. Further, each guide shaft 53 is constantly covered by the ratchet guide 60 both in the case of the rotation of the reel 26 and in the case of the stationary state. Therefore, it is possible to restrain the abrasion of the guide shaft 53.

The above-described embodiment is an example of an aspect of the present invention, and modifications and applications can be arbitrarily made without departing from the spirit of the present invention.

In the above-described embodiment, the recoil starter is attached to the electric generator 1, but without being limited to this, may be provided in various apparatuses in which an internal combustion engine is manually started, as exemplified by an outboard engine, a grass cutter and a chainsaw.

Further, the recoil 11 may be a so-called acceleration recoil starter or force accumulation recoil starter in which force accumulation means such as an assist spiral spring, or accumulation means is provided.

Further, the number of ratchet claws 50 that are provided on the reel 26 is not limited to two, and three or more ratchet claws 50 may be provided.

Further, the output shaft 8 is formed coaxially with the rotation axis A of the reel 26 as shown in FIG. 3, but without being limited to this, the output shaft 8 may be provided on a different axis from the rotation axis A.

REFERENCE SIGNS LIST

1 electric generator
8 output shaft (drive shaft)
11 recoil (recoil starter)
26 reel
27 recoil rope
30 reel boss (rotation shaft)
32 guide boss
50 ratchet claw
53 guide shaft (protrusion portion)
54 pointed end portion
55 engagement surface
60 ratchet guide (guide member)
62 guide groove
35 rib
80 pulley
A rotation axis
R rotation direction

What is claimed is:

1. A recoil starter that starts an engine, the recoil starter rotating a drive shaft of the engine using rotation force of a reel through a recoil rope wound around the reel, by the recoil rope being pulled, wherein:

a ratchet claw is provided on the reel, the ratchet claw pivoting in a radial direction of the reel with rotation of the reel by the recoil rope and then engaging with a pulley provided on the drive shaft;

a guide member is provided around a reel shaft, the guide member covering the ratchet claw, the reel shaft being a rotation shaft of the reel;

a rib is provided on the guide member, the rib abutting on the ratchet claw;

the reel has a top surface that is positioned on a side of the engine;

a containing portion in which the ratchet claw is contained is provided in the reel;

the containing portion has a concave shape that is depressed in a shaft direction of the reel shaft toward a side opposite to the engine from the top surface;

a containing surface that is a flat surface provided so as to stand from the top surface is formed on the containing portion;

an engagement surface that is a flat surface is provided on the ratchet claw; and in a case where the recoil rope is not pulled and where the reel is in a stationary state without rotating, a whole of the engagement surface abuts on the containing surface and the rib abuts on the ratchet claw, so that the ratchet claw is fixed by being sandwiched between the containing surface and the rib.

2. The recoil starter according to claim 1, wherein the rib releases the ratchet claw that moves in a circumferential direction of the guide member, with the rotation of the reel by the recoil rope being pulled.

3. The recoil starter according to claim 1, wherein:

a protrusion portion is provided on the ratchet claw;

a guide groove is provided on the guide member, the protrusion portion engaging with the guide groove;

the guide member maintains a stationary state even when the recoil rope is pulled;

the protrusion portion moves along the guide groove, with the rotation of the reel by the recoil rope being pulled; and the guide member has such a disk shape that the guide member covers the protrusion portion no matter what position in the guide groove the protrusion portion moves to.

* * * * *